US008669037B2

(12) United States Patent
Ganapathiappan et al.

(10) Patent No.: US 8,669,037 B2
(45) Date of Patent: Mar. 11, 2014

(54) INKS FOR LIQUID ELECTROPHOTOGRAPHY

(75) Inventors: Sivapackia Ganapathiappan, Los Altos, CA (US); Hou T. Ng, Campbell, CA (US); Albert Teishev, Rishon le-zion (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 63 days.

(21) Appl. No.: 13/456,364

(22) Filed: Apr. 26, 2012

(65) Prior Publication Data

US 2013/0288177 A1 Oct. 31, 2013

(51) Int. Cl.
*G03G 9/12* (2006.01)

(52) U.S. Cl.
USPC ..... 430/137.22; 430/112; 430/114

(58) Field of Classification Search
USPC ..... 430/112, 114, 137.22
See application file for complete search history.

(56) References Cited

U.S. PATENT DOCUMENTS

| | | | | |
|---|---|---|---|---|
| 5,352,557 | A * | 10/1994 | Matsuoka et al. | 430/116 |
| 7,214,460 | B2 | 5/2007 | Ishii et al. | |
| 2006/0192825 | A1 | 8/2006 | Sacoto et al. | |
| 2011/0305986 | A1 | 12/2011 | Ogawa et al. | |

FOREIGN PATENT DOCUMENTS

| | | |
|---|---|---|
| JP | 2008102434 | 5/2008 |
| JP | 2011012194 | 1/2011 |

* cited by examiner

*Primary Examiner* — Peter Vajda
(74) *Attorney, Agent, or Firm* — David W Collins

(57) ABSTRACT

A method of manufacturing a liquid electrophotographic ink includes: mixing a first portion of a carrier fluid and a resin to form a resin mixture; heating the resin mixture until the resin has melted; cooling the resin mixture to form a resin cake, followed by pulverizing the resin cake to form a resin powder; and mix the resin powder with a pigment and a second portion of carrier fluid in a microfluidizer to form a concentrating ink containing composite particles. An alternate method of manufacturing a liquid electrophotographic ink includes: mixing a pigment with a resin powder; and microfluidizing the mixture together with a carrier fluid in a microfluidizer in a number of passes to form a concentrated ink containing composite particles.

11 Claims, 1 Drawing Sheet

INKS FOR LIQUID ELECTROPHOTOGRAPHY

BACKGROUND

Digital printing involves technologies in which a printed image is created directly from digital data, for example using electronic layout and/or desktop publishing programs. Some known methods of digital printing include full-color ink-jet, electrophotographic printing, laser photo printing, and thermal transfer printing methods.

Electrophotographic (EP) printing techniques involve the formation of a latent image on a photoconductor surface mounted on an imaging plate. In some examples, the photoconductor is first sensitized to light, usually by charging with a corona discharge, and then exposed to light projected through a positive film of the document to be reproduced, resulting in dissipation of the charge in the areas exposed to light. The latent image is subsequently developed into a full image by the attraction of oppositely charged toner particles to the charge remaining on the unexposed areas. The developed image is transferred from the photoconductor to a rubber offset blanket, from which it is transferred to a substrate, such as paper, plastic or other suitable material, by heat or pressure or a combination of both to produce the printed final image.

The latent image is developed using either a dry toner (a colorant mixed with a powder carrier) or a liquid ink (a suspension of a colorant in a liquid carrier). The toner or ink generally adheres to the substrate surface with little penetration into the substrate. The quality of the final image is largely related to the size of the particles, with higher resolution provided by smaller particles.

Dry toners used in solid electrophotography are fine powders with a relatively narrow particle size distribution that are expelled from fine apertures in an application device. Liquid inks used in liquid electrophotography are generally comprised of pigment- or dye-based thermoplastic resin particles suspended in a non-conducting liquid carrier, generally a saturated hydrocarbon.

HP Electrolnk is a unique liquid ink (Liquid EP) that combines the advantages of electronic printing with the qualities of liquid ink. HP Electrolnk contains charged pigmented particles in a liquid carrier. Like other digital printing technologies, i.e. Dry EP (or xerography), HP Electrolnk enables digital printing by electrically controlling the location of the print particles. However, unlike Dry EP, HP Electrolnk enables very small particle size, down to 1 to 2 μm. HP Electrolnk is supplied as a concentrated paste that is loaded into the press in tubular cartridges in a "clean hands" operation. Inside the press, it is fed into ink supply tanks and diluted with an oil, to form a fluid mixture of carrier liquid and colorant particles ready for printing.

DETAILED DESCRIPTION

Figure 1:
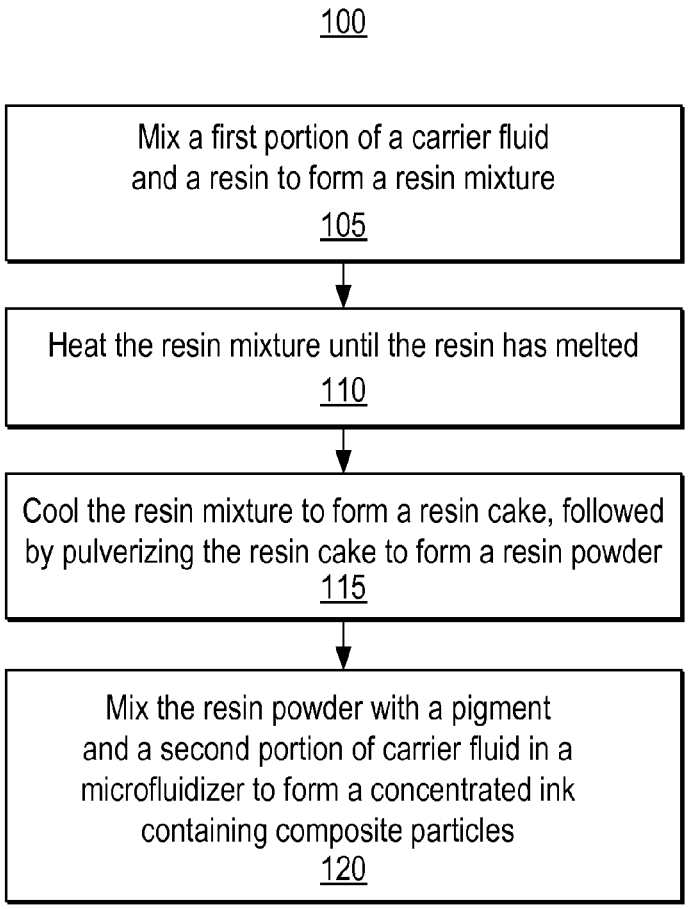
FIG. 1 is a flow chart depicting a method in accordance with examples of the present invention.

It is to be understood that this disclosure is not limited to the particular process steps and materials disclosed herein because such process steps and materials may vary somewhat. It is also to be understood that the terminology used herein is used for the purpose of describing particular examples only. The terms are not intended to be limiting because the scope of the present disclosure is intended to be limited only by the appended claims and equivalents thereof.

It is noted that, as used in this specification and the appended claims, the singular forms "a," "an," and "the" include plural referents unless the context clearly dictates otherwise.

As used herein, "carrier fluid", "carrier liquid", or "liquid vehicle" refers to the fluid in which the pigmented resin material of the present disclosure can be dispersed to form an ink dispersion. Such a carrier liquid can be formulated for electrophotographic printing so that the electrophotographic ink has a viscosity and conductivity for such printing, and may include a mixture of a variety of different agents, including without limitation, surfactants, organic solvents and co-solvents, charge control agents, viscosity modifiers, sequestering agents, stabilizing agents, and anti-kogation agents. Though not part of the electrophotographic liquid vehicle per se, in addition to the pigment and resin, the liquid vehicle can further carry solid additives such as resins, latexes, UV curable materials, plasticizers, salts, charge control agents, etc.

As used herein, "co-solvent" refers to any solvent, including organic solvents, present in the electrophotographic liquid vehicle.

As used herein, "pigment" generally includes pigment colorants, magnetic particles, aluminas, silicas, and/or other ceramics, organo-metallics or other opaque particles, whether or not such particulates impart color. Thus, though the present description primarily exemplifies the use of pigment colorants, the term "pigment" can be used more generally to describe not only pigment colorants, but other pigments such as organometallics, ferrites, ceramics, etc. In one specific example, however, the pigment is a pigment colorant.

As used herein, "ethylene acrylic acid copolymer resin" generally refers to both ethylene acrylic acid copolymer resins and ethylene methacrylic acid copolymer resins, unless the context dictates otherwise.

As used herein, "substituted" means that a hydrogen atom of a compound or moiety is replaced by another atom such as a carbon atom or a heteroatom, which is part of a group referred to as a substituent. Substituents include, for example, alkyl, alkoxy, aryl, aryloxy, alkenyl, alkenoxy, alkynyl, alkynoxy, thioalkyl, thioalkenyl, thioalkynyl, thioaryl, etc.

As used herein, the term "about" is used to provide flexibility to a numerical range endpoint by providing that a given value may be "a little above" or "a little below" the endpoint, and may be related to manufacturing tolerances. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and subrange is explicitly recited. As an illustration, a numerical range of "about 1 wt % to about 5 wt %" should be interpreted to include not only the explicitly recited values of about 1 wt % to about 5 wt %, but also include individual values and sub-ranges within the indicated range. Thus, included in this numerical range are individual values such as 2, 3.5, and 4 and sub-ranges such as from 1 to 3, from 2 to 4, and from 3 to 5, etc. This same principle applies to ranges reciting only one numerical value. Furthermore, such an interpretation should apply regardless of the breadth of the range or the characteristics being described.

Liquid electrophotographic (LEP) inks currently used in digital printing presses typically employ a pigment in a carrier, usually a hydrocarbon-based carrier, such as an isoparaffinic liquid (ISOPAR®, a series of isoparaffinic liquids available from Exxon Chemicals, Houston, Tex., is an example of a suitable carrier). The LEP inks may often include a resin, as well as other ink components for adjusting various desirable properties. The resin holds the pigment on the print media. Other ink components may include a charge director and a silicone additive to help transfer the ink from a blanket to the print media and to extend the life of the blanket.

Current ink production involves multiple steps:

- mixing a carrier fluid, such as an ISOPAR®, and a first resin, such as a polyethylene resin, to form a resin mixture;
- heating the resin mixture until the resin has melted;
- cooling the resin mixture to form resin particles;
- grinding the resin particles with a pigment to form composite particles in a paste, using beads, e.g., zirconia beads, in the grinding process;
- removing the beads from the paste by diluting the paste with the carrier fluid and mechanically filtering out the beads;
- concentrating the diluted bead-free mixture by removing excess carrier fluid to form another paste; and
- packaging the paste for shipping.

Upon receipt of the paste by the operator/printer, the ink is formed by adding a sufficient quantity of a carrier fluid, as well as charge director(s) and additive(s).

A simpler method of ink production is desired for improving cost per page (CPP) without decreasing image quality. One of the image qualities is the optical density (OD) of images. Each color behaves differently and requires different amounts of pigments to have the desired color. Prints with low OD will not look good. Performance of yellow ink is usually the worst compared to other pigments in the high throughput production process, since the pigment has to be dispersed in the highly viscous resin mixture at melt temperature. When the inks are heated at higher temperature during the process, the pigment can degrade or undergo chemical reaction with the resin particles leading to color change. This can affect the OD, chroma, and print properties. Special methods may be required to improve the OD for yellow ink.

In order to reduce the number of steps, microfluidization has been shown as a possibility to increase the throughput of ink production. Although it has been successful for a few process colors such as cyan and magenta, the optical density (OD) of the yellow inks has been significantly low. A better process to improve its OD may be desired for practical applications, namely, improving cost per page (CPP) without decreasing image quality.

In accordance with the teachings herein, a relatively simple high-throughput production method is provided for fabricating inks, particularly yellow inks. In the process, resin pellets (with or without viscosity modifier(s)) may be melted and mixed well at close to or slightly above the highest Vicat softening point of the resins, typically between 90° to 120° C. While maintaining in this temperature range, the carrier (a hydrocarbon fluid such as ISOPAR®) may be added. In general, the amount of carrier added is sufficient to provide a target solid content of 30 to 50% non-volatile solids (NVS). Once a uniform mixture or solution is formed, it may be cooled to ambient temperature while stirring the reaction mixture. The composite material obtained may be pulverized through a sieve, such as a 500 μm size sieve. Next, microfluidization may be performed with these resin powder using a hydrocarbon liquid, such as ISOPAR®, as the channel fluid. At the same time, the required amount of yellow pigment may be added into the inlet of the microfluidizer. During this process, the particle size of resins and pigments may be reduced and the pigments may be attached to the resin particles.

Thus, as depicted in FIG. 1, a method 100 of manufacturing a liquid electrophotographic ink may include:

- mixing 105 a first portion of a carrier fluid and a resin to form a resin mixture;
- heating 110 the resin mixture until the resin has melted;
- cooling 115 the resin mixture to form a resin cake, followed by pulverizing the resin cake through a sieve; and
- mixing 120 the resin powder with a pigment and a second portion of carrier fluid in a microfluidizer to form a concentrated ink that contains composite particles.

During mixing 105, the first portion of the carrier fluid and the resin are combined in a ratio ranging from about 25 to 75 wt % of resin.

During heating 110, the temperature of heating may be sufficient to melt the resin (or resin mixture) and thus may be in the range of about 50° to 175° C., depending on the resin composition. It is not necessary to heat higher than the melting temperature of the resins, as in other procedures.

Following cooling 115, the resin cake obtained may be powdered to have a particle size in a range of about 10 to 1,000 μm. This may be done by pulverizing the resin cake through a sieve of a desired size, such as a 500 μm sieve.

During microfluidizing, the heat exchanger may be maintained at about 5° to 20° C. The microfluidizer may use, for example, a 60 to 500 μm nozzle auxiliary and interaction chamber with a pressure at the nozzle of about 1,000 to 25,000 psi to produce high shear on the particles.

The composite particles, comprising pigments attached to the resin particles, that are formed as a result of microfluidizing generally may be about 1 to 10 μm in size in some examples and about 2 to 5 μm in other examples.

Following microfluidizing, the concentrated ink is ready for packaging and shipping to an operator/printer, where it may be diluted with additional carrier to the appropriate concentration for printing. At this time, charge directors, transfer additives (to aid in the transfer of ink from the blanket to the print media), viscosity modifiers, and the like, may be added.

Generally, the liquid electrophotographic ink can include a carrier fluid such as an aliphatic hydrocarbon including substituted or unsubstituted, linear or branched, aliphatic compounds. Additionally, such hydrocarbons can include aryl substituents. In one example, the aliphatic hydrocarbons can be substantially nonaqueous, i.e. containing less than 0.5 wt % water. In another example, the aliphatic hydrocarbons can be nonaqueous, i.e. containing no water. The aliphatic hydrocarbons can comprise a member selected from the group of paraffins, isoparaffins, oils, alkanes having from about 6 to about 100 carbon atoms, and mixtures thereof.

Additionally, the aliphatic hydrocarbons, or carrier fluid, can be isoparaffins, such as or equivalent to the ISOPAR® high-purity isoparaffinic solvents with narrow boiling ranges marketed by Exxon Mobil Corporation (Fairfax, Va., USA). Also suitable as an aliphatic solvent or cosolvent, for implementing examples of the present invention are alkanes having from about 6 to about 14 carbon atoms such as solvents sold under the NORPAR® (NORPAR® 12, 13 and 15) tradename available from Exxon Mobil Corporation (Fairfax, Va., USA). Other hydrocarbons for use as an aliphatic solvent, or cosolvent, are sold under the AMSCO® (AMSCO® 460 and OMS) tradename available from American Mineral Spirits Company (New York, N.Y., USA), under the SOLTROL® tradename available from Chevron Phillips Chemical Company LLC (The Woodlands, Tex., USA) and under the SHELLSOL® tradename available from Shell Chemicals Limited (London, UK). Such an aliphatic solvent, or cosolvent, can have desirable properties such as low odor, lack of color, selective solvency, good oxidation stability, low electrical conductivity, low skin irritation, low surface tension, superior spreadability, narrow boiling point range, non-corrosive to metals, low freeze point, high electrical resistivity, low surface tension, low latent heat of vaporization and low photochemical reactivity.

The resin may be any of the polyethylene resins commonly used in LEP inks, such as ethylene acid copolymers and ethylene vinyl acetate copolymers. Examples of such copolymers include, but are not limited to, ethylene acid copolymers; ethylene acrylic acid copolymers; methacrylic acid copolymers; ethylene vinyl acetate copolymers; copolymers of ethylene acid (60 to 99.9 wt %), acrylic acid, or methacrylic acid (40 to 0.1 wt %) and alkyls (with carbon chain lengths between 1 and 20 carbons, inclusive); esters of methacrylic acid or acrylic acid (0.1 to 20 wt %); polyethylene; polystyrene; isotactic polypropylene (crystalline); ethylene ethyl acrylate; polyesters; polyvinyl toluene; polyamides; styrene/butadiene copolymers; epoxy resins; acrylic resins (e.g., copolymer of acrylic or methacrylic acid and at least one alkyl ester of acrylic or methacrylic acid where the alkyl is from 1 to about 20 carbon atoms, such as methyl methacrylate (50 wt % to 90 wt %)/methacrylic acid (0 wt % to 20 wt %)/ethylhexylacrylate (10 wt % to 50 wt %)); ethylene-acrylate terpolymers; ethylene-acrylic esters-maleic anhydride (MAH) or glycidyl methacrylate (GMA) terpolymers; low molecular weight ethylene-acrylic acid ionomers (i.e., those having a molecular weight less than 1000 amu), or combinations thereof. In one example, the polymer resin is selected from the NUCREL® or BYNEL® family of polymers (available from DuPont Company, Wilmington, Del., USA, e.g., NUCREL® 403, NUCREL® 407, NUCREL® 609HS, NUCREL® 908HS, NUCREL® 1202HC, NUCREL® 30707, NUCREL® 1214, NUCREL® 903, NUCREL® 3990, NUCREL® 910, NUCREL® 925, NUCREL® 609, NUCREL® 599, NUCREL® 960, NUCREL® RX 76, NUCREL® 2806, BYNEL® 2002, BY-NEL® 2014, and BYNEL® 2020), the ACLYN® family of polymers (available from Honeywell International, Inc., Morristown, N.J., USA, e.g., AC-LYN® 201, ACLYN® 246, ACLYN® 285, and ACLYN® 295), or the LOTADER® family of polymers (available from Arkema, Inc., King of Prussia, Pa., USA, e.g., LOTADER® 2210, LOTADER® 3430, and LOTADER® 8200).

Although the pigment can be any pigment of any color, yellow pigments are most beneficially processed according to the procedures described herein. Non-limiting examples of suitable yellow pigments include C.I. Pigment Yellow 1, C.I. Pigment Yellow 2, C.I. Pigment Yellow 3, C.I. Pigment Yellow 4, C.I. Pigment Yellow 5, C.I. Pigment Yellow 6, C.I. Pigment Yellow 7, C.I. Pigment Yellow 10, C.I. Pigment Yellow 11, C.I. Pigment Yellow 12, C.I. Pigment Yellow 13, C.I. Pigment Yellow 14, C.I. Pigment Yellow 16, C.I. Pigment Yellow 17, C.I. Pigment Yellow 24, C.I. Pigment Yellow 34, C.I. Pigment Yellow 35, C.I. Pigment Yellow 37, C.I. Pigment Yellow 53, C.I. Pigment Yellow 55, C.I. Pigment Yellow 65, C.I. Pigment Yellow 73, C.I. Pigment Yellow 74, C.I. Pigment Yellow 75, C.I. Pigment Yellow 81, C.I. Pigment Yellow 83, C.I. Pigment Yellow 93, C.I. Pigment Yellow 94, C.I. Pigment Yellow 95, C.I. Pigment Yellow 97, C.I. Pigment Yellow 98, C.I. Pigment Yellow 99, C.I. Pigment Yellow 108, C.I. Pigment Yellow 109, C.I. Pigment Yellow 110, C.I. Pigment Yellow 113, C.I. Pigment Yellow 114, C.I. Pigment Yellow 117, C.I. Pigment Yellow 120, C.I. Pigment Yellow 124, C.I. Pigment Yellow 128, C.I. Pigment Yellow 129, C.I. Pigment Yellow 133, C.I. Pigment Yellow 138, C.I. Pigment Yellow 139, C.I. Pigment Yellow 147, C.I. Pigment Yellow 151, C.I. Pigment Yellow 153, C.I. Pigment Yellow 154, Pigment Yellow 155, C.I. Pigment Yellow 167, C.I. Pigment Yellow 172, and C.I. Pigment Yellow 180. In some examples, a mixture of pigments is employed, such as Pigment Yellow 154 and Pigment Yellow 74 or any other combinations from the above list of pigments.

Generally, the charge director can be a negative charge director (NCD) or a synthetic charge director (SCD). In one example, the charge director can be an NCD comprising a mixture of charging components. In another example, the NCD can comprise at least one of the following: zwitterionic material, such as soya lecithin; basic barium petronate (BBP); calcium petronate; isopropyl amine dodecylebezene sulfonic acid; etc. In one specific non-limiting example, the NCD can comprise soya lecithin at 6.6% w/w, BBP at 9.8% w/w, isopropyl amine dodecylebezene sulfonic acid at 3.6% w/w and about 80% w/w isoparaffin (Isopar®-L from Exxon). Additionally, the NCD can comprise any ionic surfactant and/or electron carrier dissolved material. In one example, the charge director can be a synthetic charge director. The charge director can also include aluminum tri-stearate, barium stearate, chromium stearate, magnesium octoate, iron naphthenate, zinc napththenate, and mixtures thereof An example of a transfer additive is a silicone oil or a fluoroalkane derivative.

In an alternative example, for simplicity, the required amount of pigments may be mixed with a resin powder and microfluidized with a number of passes, for example, three passes, to obtain the final ink. As in the above approach, the heat exchanger may be maintained at a temperature within the range of 5° to 20° C. Using these methods, NVS can be easily increased up to 28% for the yellow ink. Once the ink is made, it may be tested on the press using the conventional charge directors. Good image quality can be routinely obtained.

Figure 2:
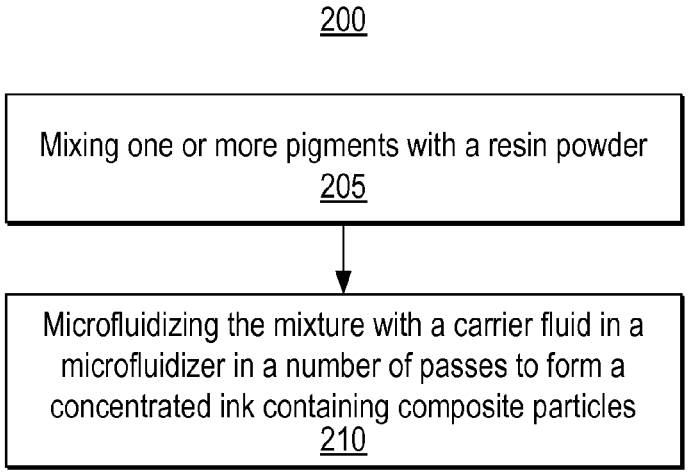
FIG. 2 is a flow chart depicting a method in accordance with examples of the present disclosure.

As depicted in FIG. 2, a method 200 includes:

mixing 205 one or more pigments with a resin powder; and microfluidizing 210 the mixture in a microfluidizer in a number of passes to form a concentrated ink that contains composite particles.

In this instance, the starting material is a resin powder, rather than a resin (as in the first method 100), which is usually available in pellet form. This may mean taking resin pellets and reducing them to powder before beginning this alternative method. For example, the resin powder may have a particle size of about 10 to 1,000 μm.

The microfluidizer may use, for example, a 60 to 500 μm nozzle auxiliary and interaction chamber with a pressure at the nozzle of about 1,000 to 25,000 psi to produce high shear on the particles. The number of passes in some examples may be three, although fewer or more passes may be employed.

The composite particles, comprising pigments attached to the resin particles, that are formed as a result of microfluidizing generally may be about 1 to 10 μm in size in some examples and about 2 to 5 μm in other examples.

Following microfluidizing, the concentrated ink is ready for packaging and shipping to an operator/printer, where it may be diluted with additional carrier to the appropriate concentration for printing. At this time, charge directors and/or transfer additives (to aid in the transfer of ink from the blanket to the print media), viscosity modifiers, and the like, may be added.

The resin(s), pigment(s), charge director(s), and additive(s) described in connection with the first method 100 may be used in this alternative method 200.

EXAMPLES

Example 1

Preparation of Yellow Ink and Print Tests

A proprietary mixture of polyethylene resins (130.03 g) was melted by heating to 120° C. A viscosity modifier (0.875 g) and aluminum stearate (a charge director) (3.85 g) were added and stirred well. Then ISOPAR® L (134.75 g) (preheated to 80° C.) was added. The mixture was homogenized and then cooled to ambient temperature to 47.4% NVS. The composite material obtained was powdered to 500 μm. A mixture of proprietary yellow pigments of between 4 and 20 g was mixed and added to the above resin powder. It was thoroughly mixed. ISOPAR® L (134.75 g) was taken in the microfluidizer and cooled to 15° C. It was microfluidized by adding the above resin powder with pigment mixture. Finally, the yellow ink was collected as 21% NVS material. The ink at this stage was ready for shipping.

The ink was diluted with an HP imaging oil to have 3% NVS along with a small amount of charge director. This was tested in an HP Indigo digital press with a standard test pattern. The OD obtained was 1.05 and the adhesion was very good, similar to HP Electrolnk 4.5.

Example 2

Comparative Example to Example 1

Example 1 was repeated with the same set of materials under identical conditions except by adding the pigment mixture with the melted resin.

The ink obtained in this case only exhibited an OD of 0.6 even though adhesion was good in the press conditions.

On the other hand, the paper coupons obtained for a 0.1% NVS sample exhibited poor OD for the Example 2 whereas OD of the ink for Example 1 was 0.95.

Example 3

Comparative Example to Example 1

Example 2 was repeated by increasing the amount of pigments by 20%. The OD obtained in this case was also 0.6 in the press.

Example 4

Comparative Example to Example 1

Example 2 was repeated by varying the ratio of the yellow pigments or by varying the ratio of the resins. In all cases, the resultant OD was 0.6, similar to Example 3.

These experiments clearly indicate that separating the pigments from the resins during the initial stage helps to considerably improve the OD, on a par with the reference ink. The highest OD with lowest amount of pigment can be obtained when the pigment is not included with the resin melt, but rather added in later in the method, in the microfluidizer. Similarly, other color inks can be made with other pigments, likewise with an improvement in OD.

The present invention provides an effective solution to address the OD issue without affecting print process or print properties. The process is also simple and high NVS inks up to 28% with low viscosity can be address OD issue without affecting print process or print properties. The same process and conditions are equally applicable to all the colored pigments.

What is claimed is:

1. A method of manufacturing a liquid electrophotographic ink including:

mixing a first portion of a carrier fluid and a resin to form a resin mixture;

heating the resin mixture until the resin has melted;

cooling the resin mixture to form a resin cake, followed by pulverizing the resin cake to form a resin powder; and mixing the resin powder with a pigment and a second portion of carrier fluid in a microfluidizer to form a concentrated ink containing composite particles.

2. The method of claim 1 wherein the first portion of the carrier fluid and the resin are combined in a ratio ranging from about 25 to 75 wt % of resin.

3. The method of claim 1 wherein the carrier fluid is selected from the group consisting of aliphatic hydrocarbons, including substituted or unsubstituted, linear or branched, aliphatic compounds, as well as aliphatic hydrocarbons with aryl substituents.

4. The method of claim 3 wherein the aliphatic hydrocarbons are selected from the group consisting of paraffins, isoparaffins, oils, alkanes having from about 6 to about 100 carbon atoms, and mixtures thereof.

5. The method of claim 1 wherein the resin is selected from the group consisting of ethylene acid copolymers and ethylene vinyl acetate copolymers.

6. The method of claim 1 wherein the resin mixture is heated to a temperature within a range of about 50° to 175° C.

7. The method of claim 1 wherein the resin powder after cooling has a particle size of within a range of about 10 to 1,000 μm.

8. The method of claim 1 wherein the microfluidizer uses a 60 to 500 μm nozzle auxiliary and interaction chamber with a pressure at the nozzle of about 1,000 to 25,000 psi.

9. The method of claim 1 wherein the composite particles comprise pigments attached to the resin particles and have a particle size ranging from about 1 to 10 μm.

10. The method of claim 1 wherein the pigment is a yellow pigment selected from the group consisting of C.I. Pigment Yellow 1, C.I. Pigment Yellow 2, C.I. Pigment Yellow 3, C.I. Pigment Yellow 4, C.I. Pigment Yellow 5, C.I. Pigment Yellow 6, C.I. Pigment Yellow 7, C.I. Pigment Yellow 10, C.I. Pigment Yellow 11, C.I. Pigment Yellow 12, C.I. Pigment Yellow 13, C.I. Pigment Yellow 14, C.I. Pigment Yellow 16, C.I. Pigment Yellow 17, C.I. Pigment Yellow 24, C.I. Pigment Yellow 34, C.I. Pigment Yellow 35, C.I. Pigment Yellow 37, C.I. Pigment Yellow 53, C.I. Pigment Yellow 55, C.I. Pigment Yellow 65, C.I. Pigment Yellow 73, C.I. Pigment Yellow 74, C.I. Pigment Yellow 75, C.I. Pigment Yellow 81, C.I. Pigment Yellow 83, C.I. Pigment Yellow 93, C.I. Pigment Yellow 94, C.I. Pigment Yellow 95, C.I. Pigment Yellow 97, C.I. Pigment Yellow 98, C.I. Pigment Yellow 99, C.I. Pigment Yellow 108, C.I. Pigment Yellow 109, C.I. Pigment Yellow 110, C.I. Pigment Yellow 113, C.I. Pigment Yellow 114, C.I. Pigment Yellow 117, C.I. Pigment Yellow 120, C.I. Pigment Yellow 124, C.I. Pigment Yellow 128, C.I. Pigment Yellow 129, C.I. Pigment Yellow 133, C.I. Pigment Yellow 138, C.I. Pigment Yellow 139, C.I. Pigment Yellow 147, C.I. Pigment Yellow 151, C.I. Pigment Yellow 153, C.I. Pigment Yellow 154, Pigment Yellow 155, C.I. Pigment Yellow 167, C.I. Pigment Yellow 172, and C.I. Pigment Yellow 180.

11. The method of claim 10 wherein a mixture of two pigments is employed.

* * * * *

UNITED STATES PATENT AND TRADEMARK OFFICE

CERTIFICATE OF CORRECTION

PATENT NO. : 8,669,037 B2
APPLICATION NO. : 13/456364
DATED : March 11, 2014
INVENTOR(S) : Sivapackia Ganapathiappan et al.

It is certified that error appears in the above-identified patent and that said Letters Patent is hereby corrected as shown below:

In the Claims

In column 9, lines 14-15, in Claim 10, delete "Pigment" and insert -- C.I. Pigment --, therefor.

Signed and Sealed this
Thirtieth Day of September, 2014

Michelle K. Lee

Michelle K. Lee
*Deputy Director of the United States Patent and Trademark Office*